US005938538A

United States Patent [19]

Broadbridge et al.

[11] Patent Number: 5,938,538

[45] Date of Patent: Aug. 17, 1999

[54] GOLF PUTTER

[76] Inventors: John Broadbridge, 7 Pheasant La., Bridgewater; Jeffrey V. Broadbridge, 24 Atwood St., Middlebury, both of Conn. 06762

[21] Appl. No.: 09/020,781

[22] Filed: Feb. 9, 1998

[51] Int. Cl.[6] ..... A63B 53/04

[52] U.S. Cl. ..... 473/252; 473/313; 473/314; 473/340; 473/328

[58] Field of Search ..... 473/313, 314, 473/328, 340, 341, 252

[56] References Cited

U.S. PATENT DOCUMENTS

| | | |
|---|---|---|
| Re. 19,178 | 5/1934 | Spiker . |
| 1,531,821 | 3/1925 | Scott . |
| 2,820,638 | 1/1958 | Morrison . |
| 3,039,776 | 6/1962 | Faini . |
| 4,795,157 | 1/1989 | Bencriscutto . |
| 4,852,879 | 8/1989 | Collins . |
| 4,984,799 | 1/1991 | Finney . |
| 5,167,414 | 12/1992 | Montgomery . |
| 5,335,913 | 8/1994 | White . |
| 5,344,149 | 9/1994 | Miller . |

*Primary Examiner*—Sebastiano Passaniti
*Attorney, Agent, or Firm*—Dallett Hoopes

[57] ABSTRACT

Golf putter has a flange extending rearward from the top of the putter head which raises the center of gravity to the level of the usual point of tangency where the club impacts on the ball. The shaft has an axis which, if projected down, passes along the contact surface and through a forward projection of the center of gravity.

3 Claims, 1 Drawing Sheet

GOLF PUTTER

FIELD OF THE INVENTION

This invention relates to a golf putter. More specifically, this invention relates to a golf putter which is face-balanced and a putter head which has a raised center of gravity and a correspondingly high point of tangency where the head usually contacts the ball.

BACKGROUND OF THE INVENTION

In a blade putter today the shaft usually connects to one end of the blade. To make such putters face-balanced, the shaft has a longer straight upper section and angled lower section connecting the end of the putter head. Usually the straight upper portion of the shaft of such a putter is aimed somewhere central of the putter head, often a central place on the putter face. This is called a face-balanced putter, and such balance will reduce the likelihood of a pushed or pulled putt roll.

Another characteristic of a putter which may affect the roll of the ball is the position of the center of gravity of the head. Putters today are often formed with flanges extending rearward from the lower end of the face. These putters have a lowered center of gravity of the head because of the lower flange. We have recognized that this distribution of weight has caused the ball to "hop" and not make a true roll from the point of impact. This initial hop affects the roll of the ball in two ways: by having the hop, the ball actually leaves the ground for an initial unpredictable distance so that the length of the putt cannot be accurately predicted. In addition, the direction of the roll may be affected by the incline of the green at the point where the ball lands from its initial hop.

SUMMARY OF THE INVENTION

It is an object of the invention to provide a face-balanced putter wherein the center of gravity is raised so that the shape is such that the point of tangency or usual point of contact of the ball with the face is high on the head and corresponds generally to a forward projection of the raised center of gravity.

A golf putter of the present invention comprises a head and a shaft. The head is a unitary solid having a front planar contact surface with a geometric center, a top surface, a bottom surface and a rear vertical surface having a rearward horizontal flange along the upper end thereof to impart to the solid a center of gravity raised above the geometric center of the front planar contact surface.

The shaft is joined to the head at a junction point toward one end of the head, and the shaft is an elongate element having a straight longer upper portion with a longitudinal axis and a shorter lower portion of the shaft diverging from the axis to join the head at the junction point. An imaginary downward extension of the longitudinal axis of the upper portion of the shaft extends along the generally vertical front planar contact surface of the head and through a point which is a forward projection of the center of gravity onto the front planar contact surface.

In a preferred form, the bottom surface of the head is formed with a pair of spaced parallel downward ribs extending in a direction rearward and perpendicular to the front contact surface and disposed on either side of a downward projection of the center of gravity.

BRIEF DESCRIPTION OF THE DRAWINGS

Further objects and features of the invention will be clear to those skilled in the art from a review of the following specification and drawings, all of which present a non-limiting form of the invention. In the drawings.

DESCRIPTION OF THE PREFERRED EMBODIMENT

Figure 1:
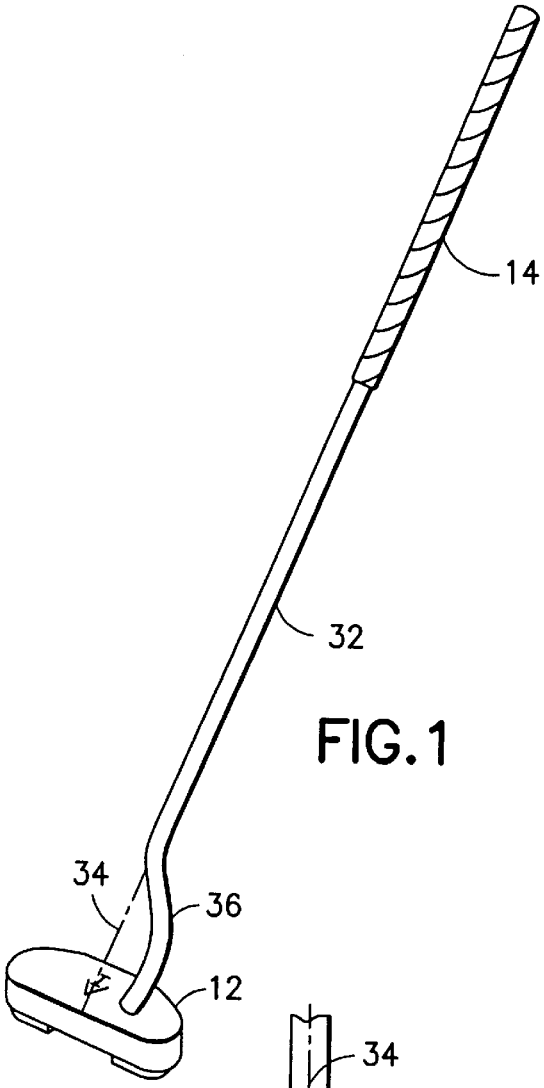
FIG. 1 is a perspective view of a putter embodying the invention.
Figure 2:
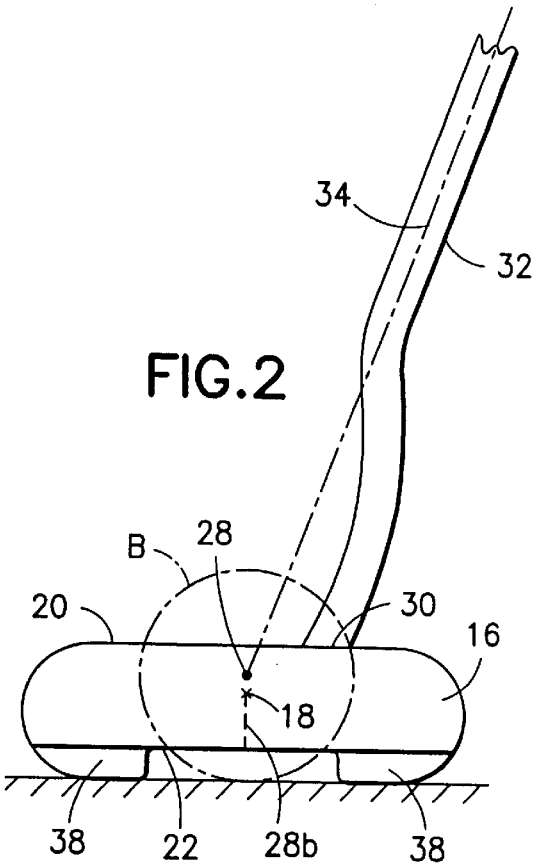
FIG. 2 is an enlarged front elevation of the lower portion of the putter.
Figure 4:
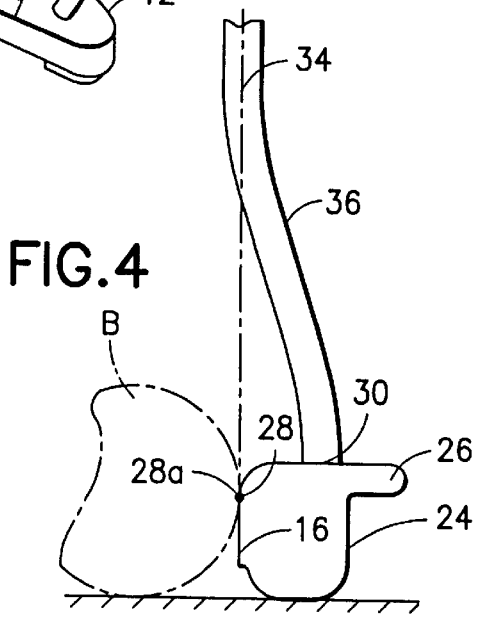
FIG. 4 is a right side view and similar to FIG. 2. In both FIGS. 2 and FIG. 4 a projection line indicates the axis of the major portion of the shaft.

A golf putter embodying the invention is generally designated 10 in FIG. 1. It comprises a head 12 and a shaft 14. The head is a unitary solid having a front planar contact surface 16 with a geometric center 18 (FIG. 2). The head has a top surface 20, a bottom surface 22 and a rear flat vertical surface (FIG. 4) 24. The rear surface is formed with an integral rearward horizontal flange 26 along the upper end thereof to impart to the solid a center of gravity 28 above the geometric center 18 of the front planar contact surface 16.

The shaft 14 is joined to the head 12 at a junction point 30 toward one end of the head 12, the shaft being an elongate element having a straight longer upper portion 32 with a longitudinal axis 34. A shorter lower portion 36 of the shaft diverges from the axis 34 to join the head at the junction point 30.

The configuration of the lower portion 36 is such that an imaginary downward extension of the longitudinal axis 34 of the longer upper portion extends along the front planar surface 16 (FIG. 4) of the head and passes through a point 28 which is a forward projection of the center of gravity 28 on the front planar contact surface 16.

To reduce friction with the ground, the bottom surface 22 is formed with a pair of ribs 38. These ribs are spaced uniformly on opposite sides of a downward projection 28*b* of the center of gravity. Thus, if the putter touches the green, contact will only be made over the relatively short narrow lower end of the ribs.

Indicia 40 are marked on the top surface 20 of the head 16 to indicate to the golfer the position of the center of gravity 28 in front of which is the "sweet spot" for the putter. Ideally, the contact with the ball B in the putting stroke is at the forward projection 28*a*.

Figure 3:
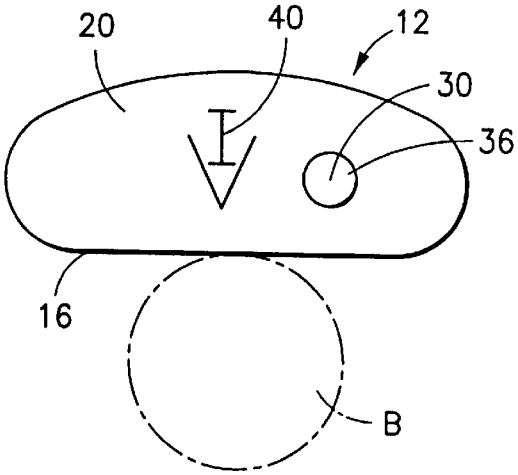
FIG. 3 is a top plan view of the putter head.

The invention presents a golf putter which is face-balanced and in which the shaft exactly relates to the plane of the face so that the golfer is immediately aware of where the face is relative to his hands. In addition, because of the top flange 26, the center of gravity is raised and the point of tangency is near the upper end of the face in front of the center of gravity giving the putter stroke minimal interference from imbalances due to any offset moments of inertia during the swing. The flange 26 (FIGS. 3, 4) is formed with a rearward bulge, the farthest rearward point, and, therefore, the largest mass of the flange, being directly behind the point of tangency. This further assures the face-balanced nature of the club. The result is a putter which imparts a true roll from impact.

Variations in the invention are possible. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. A golf putter comprising a head and a shaft, the head defined by a unitary solid having a front planar contact surface with a geometric center, a top surface, a bottom surface and a rear vertical surface having an upper end and a rearward horizontal flange extending continuously along the full length of the upper end of the rear vertical surface and overhanging all other portions of the rear vertical surface to impart to the solid a center of gravity above the geometric center of the front planar contact surface, the shaft being joined to the head at a junction point toward one end of the head, the shaft being an elongate element having a straight longer upper portion with a longitudinal axis, and a shorter lower portion of the shaft diverging from the axis to join the head at the junction point, an imaginary downward extension of the longitudinal axis of the upper portion of the shaft extending along the front planar contact surface of the head and passing through a point of tangency which is a forward projection of the center of gravity onto the front planar contact surface said flange having a rearward bulge with its farthest rearward point directly behind the point of tangency.

2. A golf putter as claimed in claim 1 wherein the bottom surface is formed with a pair of spaced parallel downward ribs spaced on either side of a downward projection of the center of gravity.

3. A golf putter as claimed in claim 1 wherein indicia on the top surface indicate the center of gravity of the head.

* * * * *